United States Patent [19]

Bentley

[11] Patent Number: 4,971,130

[45] Date of Patent: Nov. 20, 1990

[54] WEATHER SEAL COVERING ASSEMBLY FOR A WINDOW

[76] Inventor: Richard P. Bentley, P.O. Box 216, Terrebonne, Oreg. 97760

[21] Appl. No.: 453,941

[22] Filed: Dec. 20, 1989

[51] Int. Cl.[5] ..... E06B 9/00

[52] U.S. Cl. ..... 160/368.1; 160/127; 52/202; 340/545

[58] Field of Search ..... 160/368.1, 354, 180, 160/179, 127; 52/202, 1, 173 R, 203; 49/13; 109/38, 43; 340/545, 546, 547

[56] References Cited

U.S. PATENT DOCUMENTS

| | | | |
|---|---|---|---|
| 2,249,927 | 7/1941 | Abramson | 160/179 X |
| 3,251,399 | 5/1966 | Grossman | 160/180 |
| 3,706,090 | 12/1972 | Callaghan | 340/547 |
| 3,796,010 | 3/1974 | Carlson | 49/477 |
| 3,797,167 | 3/1974 | Gomboc | 49/141 |
| 3,957,068 | 5/1976 | Cox | 135/15 |
| 4,031,942 | 6/1977 | Shelton | 160/180 X |
| 4,220,298 | 9/1980 | Willis | 160/354 X |
| 4,599,825 | 7/1986 | Sixsmith | 49/466 |
| 4,639,035 | 1/1987 | Isaacson | 160/354 X |
| 4,682,443 | 7/1987 | Demo | 49/466 |

FOREIGN PATENT DOCUMENTS

| | | |
|---|---|---|
| 2250741 | 5/1973 | Fed. Rep. of Germany . |
| 686195 | 1/1953 | United Kingdom . |

*Primary Examiner*—David M. Purol

*Attorney, Agent, or Firm*—T. M. Gernstein

[57] ABSTRACT

A weather seal covering assembly includes a base unit mounted on the casing surrounding the window and a covering unit releasably attached to the base unit by a triple seal. The covering unit can be removed to expose the window, and the triple seal includes a zipper unit, a snap fastener unit and a hook-and-loop unit. An intrusion alarm uses the snap fastener elements. The intrusion alarm is also activated should the covering unit be moved away from the base unit, and a vacuum system further seals the covering unit to the base unit.

4 Claims, 3 Drawing Sheets

WEATHER SEAL COVERING ASSEMBLY FOR A WINDOW

TECHNICAL FIELD OF THE INVENTION

The present invention relates to the general art of static structures, and to the particular field of windows and window coverings for buildings.

BACKGROUND OF THE INVENTION

Many home owners, renters and building owners have found that much energy can be saved and greater comfort can be achieved by covering building windows. This procedure is most often used during winter months to prevent drafts from entering the enclosure as well as to further insulate a window; however, covering the windows of a building has been found to be useful in the summertime as well.

The window coverings often include storm windows; however, it has been found that the cost and inconvenience associated with storm windows sometimes outweighs the benefits achieved by installing such window coverings.

Accordingly, many people use a flexible covering, such as translucent plastics-type materials. These materials are generally fixed, as by taping or by gluing, to the casing surrounding a window unit to cover that window. Such coverings are generally installed just prior to a winter season and removed just prior to a spring or summer season.

While less expensive than storm windows, these flexible coverings still have several disadvantages which place them at a disadvantage with respect to storm windows. Such disadvantage inhibits this type of window covering from achieving a full measure of commercial success.

For example, the requirement of removing an entire assembly from a glued or taped mounting on a window casing each year, and then cleaning glue or tape remains from the casing can be a task that is onerous enough to dissuade a potential buyer from purchasing the flexible covering assembly instead of a storm window assembly.

Since storm windows can include some sort of security alarm system, such as intrusion alarms, storm windows often have a significant selling feature as compared to a simple flexible covering that can be breached by an intruder.

Still further, even though the flexible covering is sealed to a window casing, over a period of time, draft paths can become established. Such draft paths can tend to vitiate the sealing effect of the flexible covering, thereby, again placing such coverings at a commercial disadvantage with respect to storm windows.

Still further, many of the flexible coverings presently available are easily breached by an intruder, and thus offer little or no protection against such intrusion. On the other hand, storm windows can be formed with bars and strong materials that can make them extremely difficult to breach.

Accordingly, there is a need for a flexible window covering that is commercially competitive with storm windows and which can be easily and expeditiously installed and removed while establishing and maintaining a secure closure for the window as well as having an ability to establish a leak-proof seal around the window.

OBJECTS OF THE INVENTION

It is the main object of the present invention is to provide a flexible window covering that is commercially competitive with storm windows.

It is another object of the present invention is to provide a flexible window covering that is commercially competitive with storm windows and which can be easily and expeditiously installed and removed.

It is another object of the present invention is to provide a flexible window covering that is commercially competitive with storm windows and which can be easily and expeditiously installed and removed while establishing and maintaining a secure closure for the window.

It is another object of the present invention is to provide a flexible window covering that is commercially competitive with storm windows and which can be easily and expeditiously installed and removed while establishing and maintaining a closure for the window that is secure enough to be extremely difficult for an intruder to breach.

It is another object of the present invention is to provide a flexible window covering that is commercially competitive with storm windows and which can be easily and expeditiously installed and removed while establishing and maintaining a secure closure for the window as well as having an ability to establish a leak-proof seal around the window.

SUMMARY OF THE INVENTION

These, and other, objects are achieved by a flexible window covering assembly that includes a base unit that is permanently affixed to the casing surrounding a window opening and which includes a window covering unit that is releasably connected to the base unit to be removed during a summer season and replaced during a winter season.

The assembly includes a triple seal between the base unit and the covering unit that can be released to remove the covering unit and which can be easily reestablished to replace the covering unit.

The assembly also includes an intrusion alarm system and a system that ensures the leak proof nature of the seal.

In this manner, the window covering assembly of the present invention is easily installed and removed, yet will have a reliable and secure seal. The intrusion alarm is part of the assembly and thus will permit the flexible covering to compete with storm windows in this field. The ease with which the covering can be installed and removed as well as the secure nature of the covering and its intrusion alarm features makes it commercially competitive with storm windows by including many features heretofore possessed by storm window and not flexible coverings while still being less expensive and easier to install and remove than storm windows.

BRIEF DESCRIPTION OF THE DRAWING FIGURES

DETAILED DESCRIPTION OF THE PREFERRED EMBODIMENT OF THE INVENTION

Figure 1:
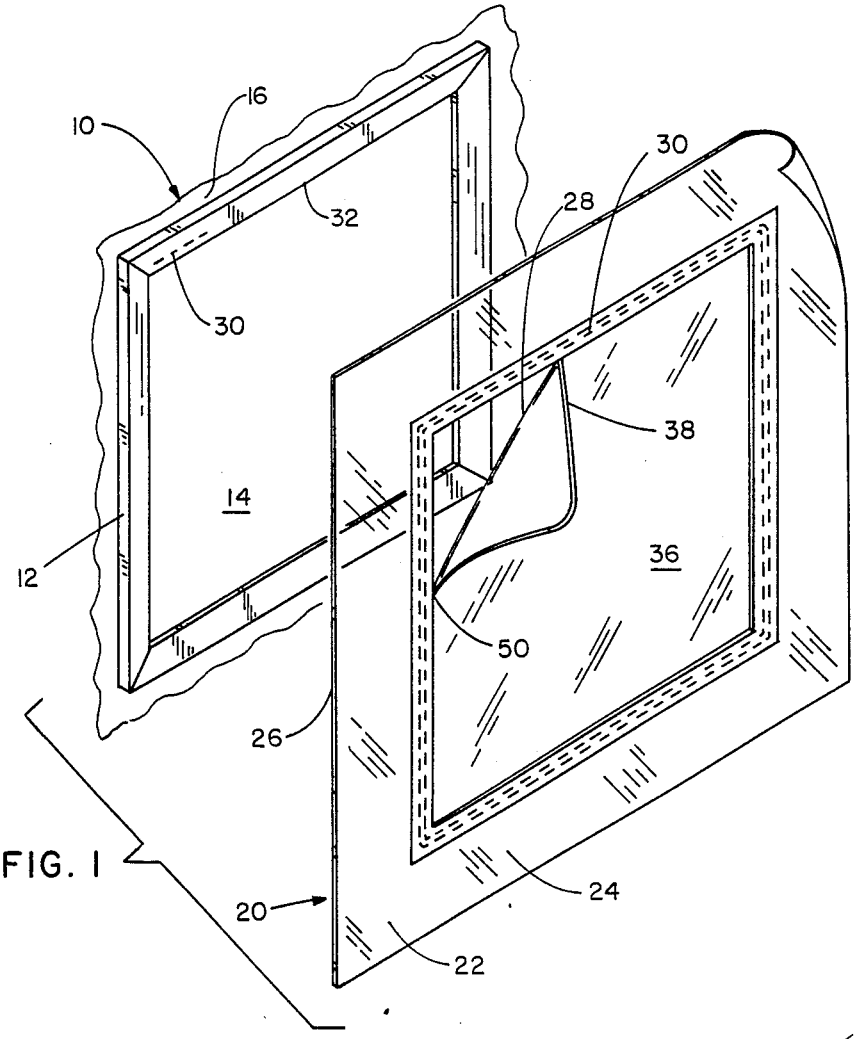
FIG. 1 is an exploded perspective view of a weather seal covering assembly of the present invention in conjunction with a window to be covered thereby.

Shown in FIG. 1 is a window 10 of the type commonly found in the building art. The window includes an interior casing 12 which peripherally surrounds the window opening 14. The casing can be formed of wood, plastic or any other suitable material, and wall 16 surrounds the casing is indicated in FIG. 1. The actual window is not shown in FIG. 1 for the sake of clarity, but any suitable form of window can be used.

A weather seal covering assembly 20 is shown in the FIGURES, and referring to FIG. 1, it is seen that the assembly 20 includes a base unit 22 that is to be fixedly attached, as by gluing or the like, to the wall 16 peripherally surrounding the window 14 and the casing 12. The base unit is preferably formed of plastics-type material, such as MYLAR plastic sheathing that has a thickness of between three and four mm as measured between front surface 24 of the base unit and rear surface 26 of that base unit.

An opening 28 is defined in the base unit and that base unit has an inner perimeter 30 that is located to lie circumadjacent to the opening 14. The inner perimeter is thus located as indicated in FIG. 1 by phantom line 30 with respect to the inner perimeter 32 of the casing.

The assembly further includes a removable window covering unit 36 that is formed of the same translucent material as is the base unit, and has the same thickness as that base unit. The covering unit has an outer perimeter 38 that is slightly larger than the inner perimeter of the window casing to lie along line 30 shown in FIG. 1 when that covering unit is mounted on the base unit in covering relation on a window.

Figure 2:
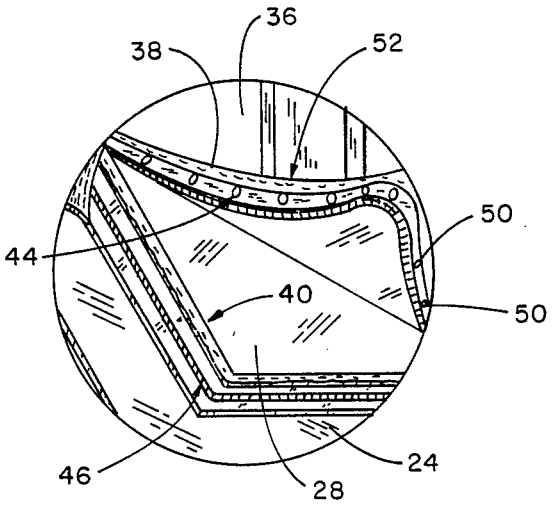
FIG. 2 is a perspective view of a portion of the covering assembly showing the triple seal of the assembly.
Figure 2A:
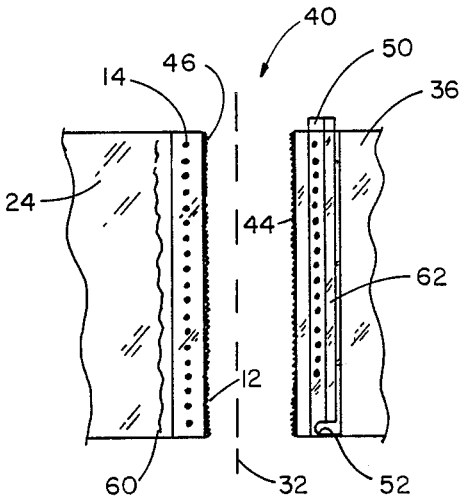
FIG. 2A is a plan view of a triple seal used to releasably couple a covering unit of the assembly to a base unit of the assembly of the present invention.

The covering unit is releasably attached to the base unit to be easily installed and easily removed to gain access to the window for cleaning or to open that window during a pleasant weather. The releasable attachment of the covering unit to the base unit is best shown in FIGS. 2 and 2A to include a triple seal 40 whereby the formation of draft paths is prevented and a secure seal is formed for intrusion alarm purposes as will be discussed below.

The triple seal 40 includes a zipper element having one set of teeth 44 on the outer peripheral edge of the window covering unit and a second set of teeth 46 on inner peripheral edge of the base element adjacent to the opening 14. The first set of teeth completely surround the covering element, and the second set of teeth completely surround the opening 14, and a pull tab element 50 is used to couple and de-couple the two sets of teeth in a manner usual to zippers and well known to those skilled in the zipper art.

A second portion of the triple seal includes a multiplicity of snap fastener elements. These snap fastener elements include a multiplicity of stud elements 50 mounted on a flap 52 attached to the covering unit, and a multiplicity of corresponding socket elements socket elements 54 mounted adjacent to the zipper teeth 46 in positions to be releasably engaged by the stud elements 50 when the flap 52 is in overlapping relation to the base element 24.

The snap fastener elements are secured together after the zipper is secured to further ensure that a weather-tight and secure seal is formed between the covering unit and the base unit.

The triple seal 40 further includes a hook-and-loop fastener element having a loop tape portion 60 located on the base unit adjacent to the snap fastener socket elements 54, and a hook tape portion 62 located on flap 52 adjacent to the snap fastener stud elements 50. The hook-and-loop fastener element is secured after the zipper and snap fastener elements have been secured to close the triple seal for aesthetic purposes as well as to further ensure a secure and weather-tight seal between the covering unit and the base unit of the window covering assembly.

The flap 52 is thus sealed to the base unit to form a pocket which completely surrounds the window. This pocket will be used to form a vacuum seal around the window that can be used in conjunction with a vacuum sensor element or the like to form a portion of an intruder alarm and is also used to further seal the closure between the base unit and the covering unit.

Figure 3:
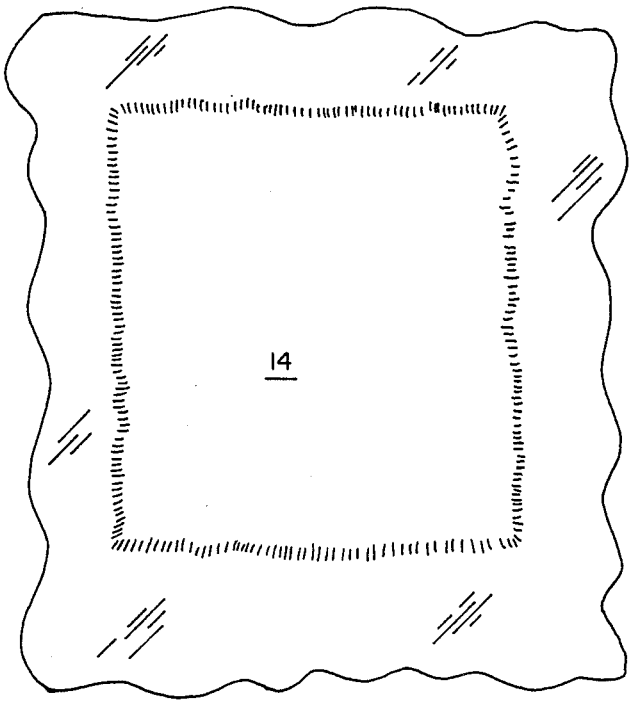
FIG. 3 is a plan view of the base unit of the assembly with the window covering unit of the assembly removed.
Figure 4:
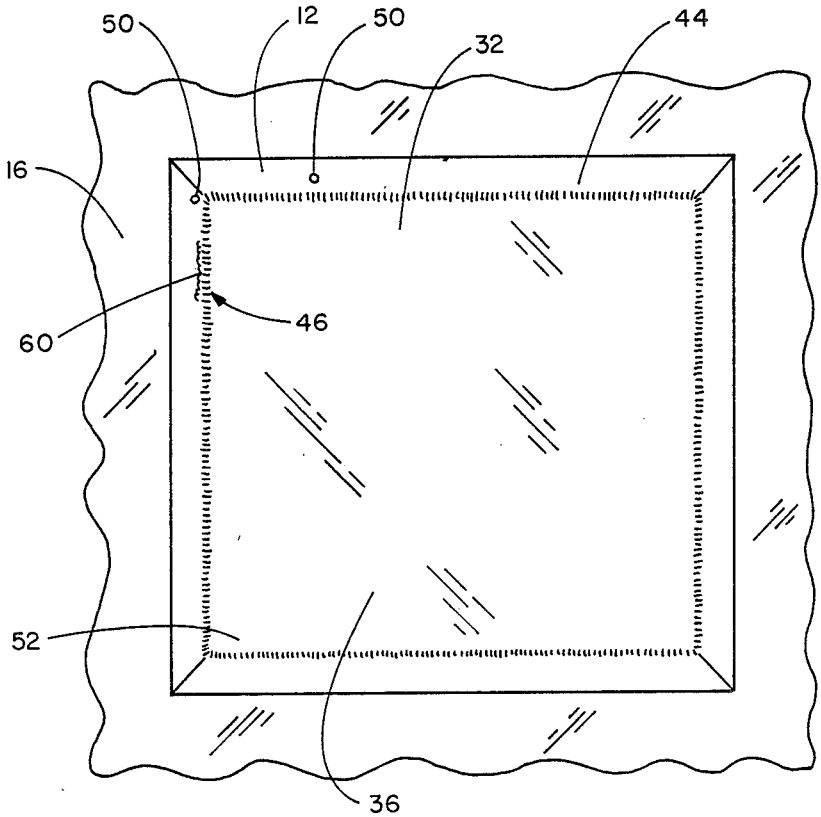
FIG. 4 is a perspective view of the assembly of the present invention in place over a window being covered.

Referring to FIGS. 3 and 4, the window opening 14 is covered by the assembly 10 by mounting the base unit adjacent to the window opening and attaching the covering unit 36 to the base unit using the triple seal 40.

The covering unit 36 is preferably formed of a high strength material, such as MYLAR or the like that will resist cutting by a knife or other such object. Thus, to gain entry via the window, an intruder will be forced to open the seal 40. Thus, the assembly 10 includes an intruder alarm system, indicated schematically in FIGS. 5 and 6. The intrusion alarm is set up to activate a signal upon the separation of any one of the snap fastener stud elements from a corresponding socket element. This signal can be an audible or visible alarm, or a silent alarm or any other signal used in the intrusion alarm art.

Figure 5:
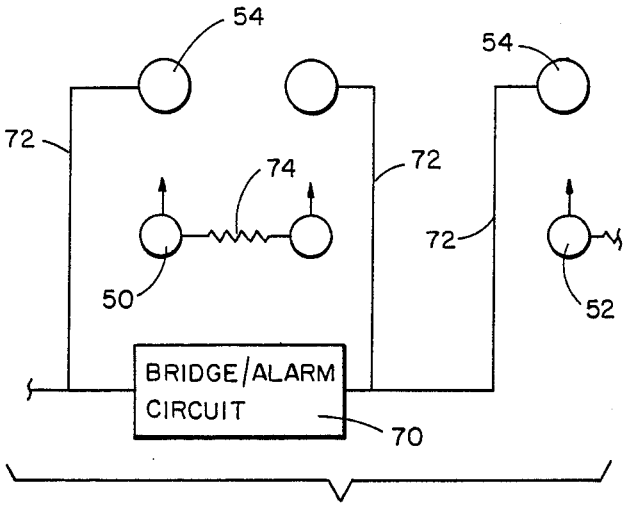
FIG. 5 is a schematic diagram showing an intrusion alarm system used in conjunction with the window covering assembly of the present invention.

The alarm is activated by a circuit such as shown in FIG. 5 as including a bridge-controlled alarm circuit 70. This circuit uses a Wheatstone Bridge element to control activation of the alarm signal, and is electrically coupled to adjacent socket elements 54 by line elements 72. The socket elements are electrically isolated from each other, and adjacent stud elements 50 are electrically connected together by a resistor element 74. When the stud elements are received in the socket elements, the socket elements will be electrically connected together by the resistor element 74. The coupled elements form one arm of the Wheatstone Bridge, and the Bridge is balanced according to contact of the adjacent socket elements via the resistor 74. Thus, if one of the stud elements is removed from its associated socket element, the electrical coupling is broken, and the balance of the Bridge is upset. The alarm circuit is set to activate the alarm as soon as the balance of the Bridge is upset. Correspondingly, should an intruder try to short the coupling between the adjacent sockets, the balance of the Bridge will also be upset by shorting the resistor 74. Such unbalance will also activate the alarm.

As mentioned above, the covering unit is formed of a material that will not be easily cut, so the force of an attempted cutting of the covering unit will likely free at least one stud element from its associated socket element thereby activating the alarm.

Figure 6:
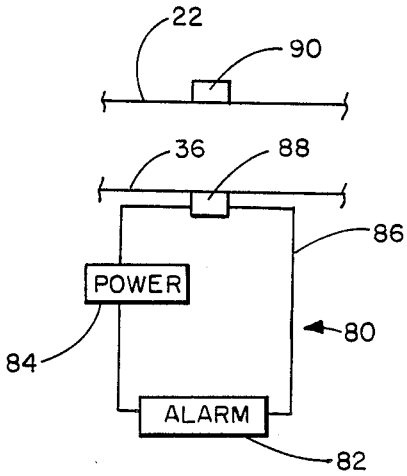
FIG. 6 is a schematic diagram showing another form of an intrusion alarm that can be used in conjunction with the window covering assembly of the present invention.

A further alarm circuit 80 is shown in FIG. 6 to include an alarm 82 that is connected to a power source 84 via line connectors 86 and a reed switch 88. The reed switch 88 is located on the covering unit and has a switch element that is biased into a closed position by a spring element. The switch element is a magnetic material and is held in the open position by a magnet 90 mounted on the base unit 22. The reed switch is well known to those skilled in the switch art, and thus will not be discussed or shown in further detail.

With the alarm circuit 80, movement of the covering unit away from the base unit will activate the alarm circuit, and thus the alarm circuit 80 can be used in conjunction with the FIG. 5 alarm circuit to ensure that the covering unit is secure against an intrusion even should an intruder successfully by-pass the snap fastener system controlled alarm circuit discussed above in relation to FIG. 5.

Figure 7:
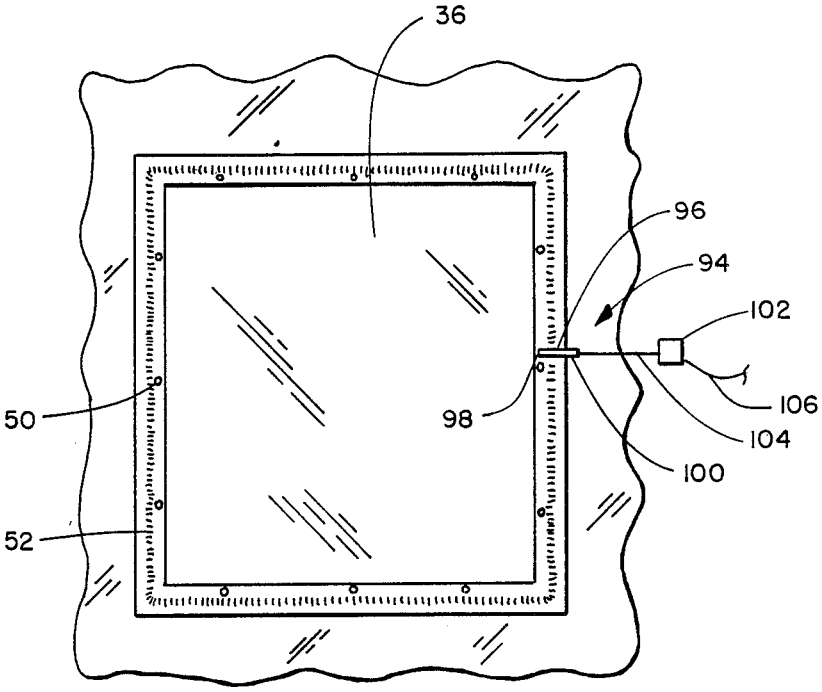
FIG. 7 is a plan view of a window covering assembly having a seal area vent system.

As above discussed, the flap 52 forms a pocket with the base unit when the hook-and-loop fastener system is coupled. As indicated in FIG. 7, the assembly 10 includes a vent system 94 fluidically coupled to the pocket. This vent system includes a vent conduit 96 mounted on the base unit and having an inlet end 98 located inside the pocket and an outlet end 100 fluidically coupled to a vacuum pump 102 by a flexible conduit 104. The pump 102 is powered by connection to utility power by a cord 106, and operates to keep the pocket surrounding the window opening pumped down. This vacuum type condition helps to insulate the window opening from the interior of the room so that further energy is saved. Any suitable vacuum pump can be used, and those skilled in the pumping art will understand what type of pump is most suitable for this process.

It is understood that while certain forms of the present invention have been illustrated and described herein, it is not to be limited to the specific forms or arrangements of parts described and shown.

I claim:

1. A weather seal covering assembly for a window comprising:

(A) a base unit fixedly attached to a casing and peripherally surrounding a window, said base unit including (1) translucent plastic body having a rear surface and a front surface and a thickness as measured between said rear surface and said front surface, and (2) an opening having an inner perimeter surrounding said window;

(B) a window covering unit removably attached to said base unit and including an outer perimeter which essentially matches the inner perimeter of said base unit;

(C) a sealing assembly releasably sealing said covering unit to said base unit and including (1) flap element on said covering unit and attached to said covering unit at an attachment location spaced from said covering unit outer perimeter, (2) a zipper unit having one set of teeth on said window covering unit outer perimeter, a second set of teeth on said base unit inner perimeter, and a pull tab element connected to said first and second sets of teeth to open and close said zipper unit, (3) a snap fastener unit having a multiplicity of stud elements mounted on said covering unit adjacent to said one set of zipper teeth and a multiplicity of socket elements mounted on said covering unit flap adjacent to said second set of zipper teeth, and (4) a hook-and-loop fastener unit having a loop tape portion mounted on said covering unit flap adjacent to said fastener element stud elements and a hook tape portion mounted on said base element adjacent to said snap fastener unit socket elements, and (5) said base unit socket elements being located between said hook tape portion and said zipper unit second set of teeth and said covering unit stud elements being located between said loop tape portion and said zipper unit one set of teeth, with said flap projecting over said zipper unit and said snap fastener unit to form a pocket with said base unit; and (D) an intrusion alarm system which includes (1) an alarm and bridge circuit which includes a Wheatstone Bridge, (2) line conductor means connecting said alarm and bridge circuit to each of adjacent pairs of said socket elements, with said socket elements being electrically insulated from each other, (3) a resistor element connecting each of a pair of adjacent stud elements together, and (4) said Wheatstone Bridge being designed so that connection of said resistor element to said Wheatstone Bridge by coupling the stud elements to the socket elements will balance said Wheatstone Bridge whereby disconnection of one stud element from a socket element or shorting of the adjacent socket elements will unbalance the Wheatstone Bridge and activate the alarm.

2. The weather seal covering assembly defined in claim 1 wherein said window covering unit is formed of MYLAR.

3. The weather seal covering assembly defined in claim 2 wherein said intrusion alarm system further includes a magnetic reed switch mounted on said covering unit, a magnet mounted on said base unit and an alarm circuit connected to a source of power via said reed switch.

4. The weather seal covering assembly defined in claim 3 further including a vacuum system which has a vent pipe connected to said pocket and vacuum pump connected to said vent pipe.

* * * * *